US006138962A

United States Patent [19]

Spooner

[11] Patent Number: 6,138,962

[45] **Date of Patent: *Oct. 31, 2000**

[54] APPARATUS FOR HOLDING OPEN A MOUTH OF A BAG

[76] Inventor: Byron D. Spooner, 20852 Beaconsfield Blvd., Rocky River, Ohio 44116

[ * ] Notice: This patent issued on a continued prosecution application filed under 37 CFR 1.53(d), and is subject to the twenty year patent term provisions of 35 U.S.C. 154(a)(2).

[21] Appl. No.: 08/846,631

[22] Filed: Apr. 30, 1997

[51] Int. Cl.[7] ..... B65B 67/04

[52] U.S. Cl. ..... 248/99; 141/314

[58] Field of Search ..... 248/99, 907, 95, 248/100, 101; 141/314, 391, 390; 383/33

[56] References Cited

U.S. PATENT DOCUMENTS

| | | | |
|---|---|---|---|
| 3,240,457 | 3/1966 | Backlund et al. | 248/99 |
| 3,697,030 | 10/1972 | Schultz | 248/101 |
| 4,006,928 | 2/1977 | Beugin . | |
| 4,023,842 | 5/1977 | Harvey . | |
| 4,064,969 | 12/1977 | Black | 184/1.5 |
| 4,196,880 | 4/1980 | Hynes | 248/99 |
| 4,638,967 | 1/1987 | MacDuffee | 248/97 |
| 4,805,858 | 2/1989 | Taylor | 248/99 |
| 4,815,866 | 3/1989 | Martone | 248/100 |
| 4,846,427 | 7/1989 | Jones | 248/95 |
| 4,981,274 | 1/1991 | McVay et al. | 248/99 |
| 5,154,378 | 10/1992 | Plum | 248/99 |
| 5,183,339 | 2/1993 | Williams . | |
| 5,222,536 | 6/1993 | Hodgdon et al. | 248/99 |
| 5,350,142 | 9/1994 | Kurtzman et al. | 248/99 |
| 5,360,189 | 11/1994 | Hart | 248/99 |
| 5,556,063 | 9/1996 | Boyd | 248/99 |

*Primary Examiner*—Anita M. King
*Assistant Examiner*—Kimberly Wood
*Attorney, Agent, or Firm*—Tarolli, Sundheim, Covell, Tummino & Szabo L.L.P.

[57] ABSTRACT

An apparatus (10) for holding open a mouth (40) of a bag (20) defined by side walls (22, 26) of the bag for facilitating placing material into the bag comprises a one-piece rectangular frame member (50) made of a resilient material. The frame member (50) has four side portions (52, 56) which lie substantially in a common plane constituting a first condition of the frame member. The four side portions (52, 56) are for engaging interior side walls (22, 26) of the bag. The side portions (52, 56) of the frame member (50) define a rectangular outer perimeter (62) of the frame member and a window (64) in the frame member through which material is placed into the bag (20). The outer perimeter (64) is slightly larger than the mouth (40) of the bag (20) measured in a plane perpendicular to the side walls (22, 26) of the bag.

6 Claims, 1 Drawing Sheet

10
20
22
26
30
32
34
38
39
40
50
52
56
60
62
64
70
72
74
76
A
B
L1
L2
L3
L4
3
50'
50"
52'
52"
56'
56"

APPARATUS FOR HOLDING OPEN A MOUTH OF A BAG

BACKGROUND OF THE INVENTION

1. Technical Field

The present invention relates to an apparatus for holding open a mouth of a bag for facilitating placing material into the bag.

2. Description of the Prior Art

Large brown paper bags are commonly used to collect and dispose of material such as lawn clippings, leaves, and the like. When such a bag is new, the mouth of the bag has a tendency to not remain open by itself when there is nothing inside the bag. Therefore, in order to initially place material into the bag, the mouth of the bag must be held open in some manner, such as by a person.

It can be cumbersome for a person trying to place material into a bag to hold the mouth of the bag open. Thus, an apparatus which holds the mouth of a bag open so that material can be placed into the bag is desirable.

It is also desirable for such an apparatus to be simple and cost-effective to manufacture.

SUMMARY OF THE INVENTION

The present invention is an apparatus for holding open a mouth of a bag, which mouth is defined by side walls of the bag, for facilitating placing material into the bag. The apparatus comprises a one-piece rectangular frame member made of a resilient material. The frame member has four side portions which preferably lie substantially in a common plane constituting a first condition of the frame member. The four side portions are for engaging interior side walls of the bag. The side portions of the frame member define a rectangular outer perimeter of the frame member and a window in the frame member through which material is placed into the bag. The outer perimeter of the frame member is slightly larger than the mouth of the bag measured in a plane perpendicular to the side walls of the bag.

The frame member may be used in two ways. First, the frame member may be inserted into the bag and then moved to a position engaging and tensioning the side walls of the bag to hold the bag open. Frictional contact between the side portions of the frame member and the side walls of the bag holds the frame in the position. Second, the frame member may be manually deformed to a second condition in which the four side portions do not lie in a common plane. The frame member may be deformed inside the bag or outside of the bag. The frame member, if deformed outside the bag, is then positioned inside the bag while in the deformed condition. The frame member resiliently springs back toward the first condition where the four side portions lie in a common plane, whereby the side portions of the frame member engage the interior side walls of the bag and tension the interior side walls and hold the mouth of the bag open.

BRIEF DESCRIPTION OF THE DRAWINGS

Further features of the present invention will become apparent to those skilled in the art to which the present invention relates from reading the following description with reference to the accompanying drawings, in which.

DESCRIPTION OF PREFERRED EMBODIMENTS

Figures 1, 2, 3, 4, 5:
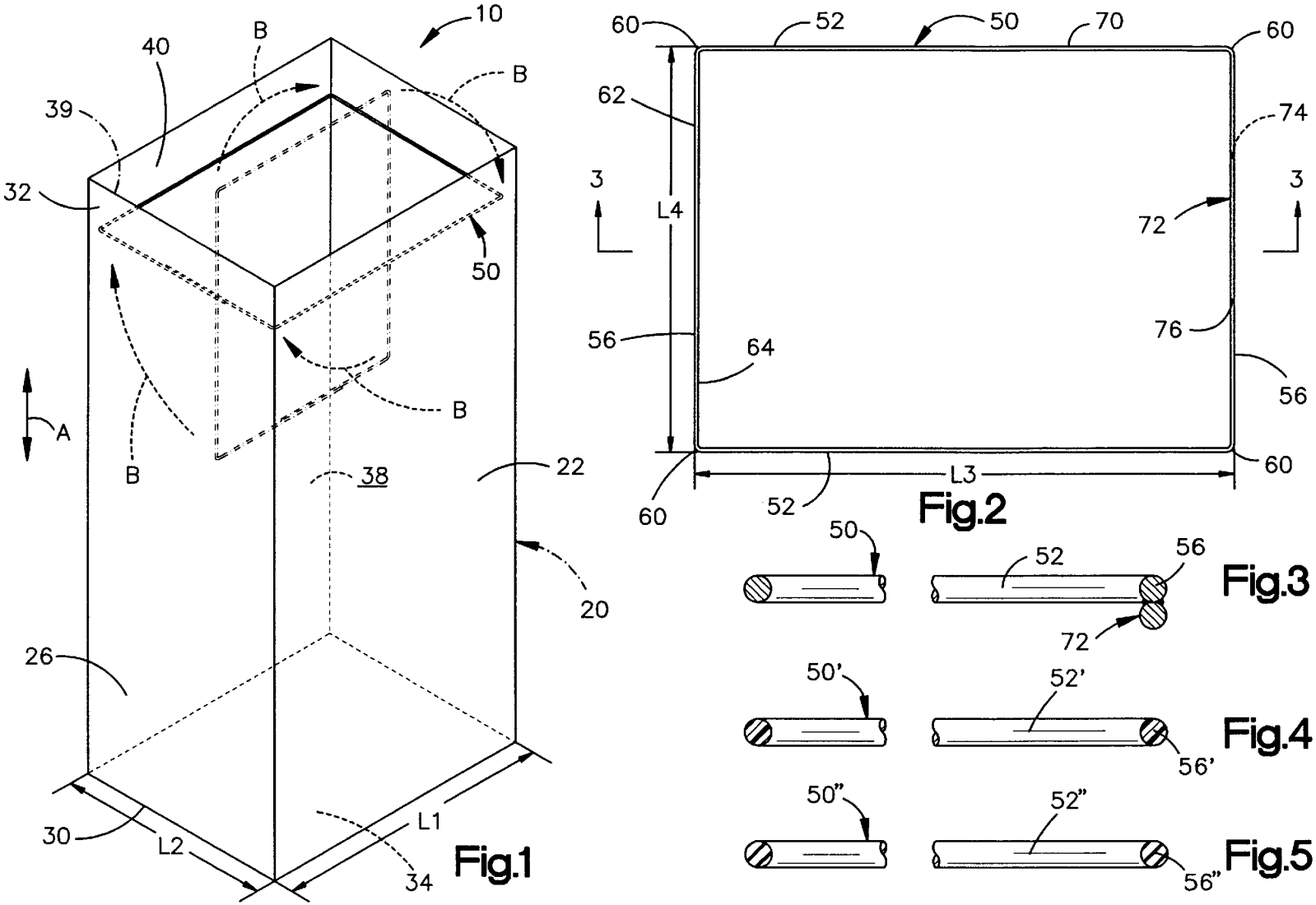
FIG. 1 is a perspective illustration of an apparatus for holding open a mouth of a bag.
FIG. 2 is a top view of the apparatus shown in FIG. 1.
FIG. 3 is a sectional view taken along line 3—3 in FIG. 2.
FIG. 4 is a view similar to FIG. 3 showing an alternate construction of the invention.
FIG. 5 is a view similar to FIG. 3 showing another alternate construction of the invention.

The present invention relates to an apparatus for holding open a mouth of a bag for facilitating placing material into the bag. The present invention is applicable to various types of bags. As representative of the present invention, FIG. 1 illustrates an apparatus 10 for holding a bag 20 open.

The bag 20 is constructed of paper and is primarily used to collect and dispose of lawn clippings, leaves, and the like. The bag 20 is rectangular in cross-section and includes a first pair of opposing side walls 22 which have an equal length L1. A second pair of opposing side walls 26 which have an equal length L2, extend between the first pair of side walls 22. The second pair of side walls 26 are shorter in length than the first pair of side walls 22. In the preferred embodiment shown in FIG. 1, the length L1 of the first pair of side walls 22 is approximately 16 inches long and the length L2 of the second pair of side walls 26 is approximately 12 inches long. The length of the side walls can, of course, be different than the preferred embodiment.

The first and second pairs of side walls 22 and 26 extend from a first end 30 of the bag 20 to a second end 32 of the bag. At the first end 30 of the bag 20, a bottom wall 34 extends perpendicular to and interconnects the first and second pairs of side walls 22 and 26. The bottom wall 34 and the first and second pairs of side walls 22 and 26 together define a compartment 38 inside the bag 20. At the second end 32 of the bag 20, an edge 39 defines an open mouth 40 which lies in a horizontal plane that is parallel to the bottom wall 34 of the bag.

The apparatus 10 comprises a one-piece frame 50 made of a resilient material. The frame 50 is rectangular in shape. The frame 50 includes a first pair of opposing side portions 52 and a second pair of opposing side portions 56. The first and second pairs of side portions 52 and 56 of the frame 50 preferably lie in a single common plane which constitutes a first condition of the frame.

The first pair of opposing side portions 52 have an equal length L3 and are parallel to each other. The second pair of opposing side portions 56 have an equal length L4 and are also parallel to each other. In the illustrated embodiment, the second pair of side portions 56 are shorter in length than the first pair of side portions 52. The first and second pairs of side portions 52 and 56 are interconnected at four 90° corners 60.

The length L3 of the first pair of side portions 52 of the frame 50 is slightly larger than the length L1 of the first pair of side walls 22 of the bag 20. The length L4 of the second pair of side portions 56 of the frame 50 is slightly larger than the length L2 of the second pair of side walls 26 of the bag 20. In the preferred embodiment shown in FIG. 1, the length L3 of the first pair of side portions 52 is approximately 16 to 16.25 inches long and the length L4 of the second pair of side portions 56 is approximately 12 to 12.25 inches long.

The first and second pairs of side portions 52 and 56 and the corners 60 together define an outer perimeter 62 for the frame 50. Thus, in the preferred embodiment, the dimensions of the outer perimeter 62 are approximately equal to the lengths L3 and L4 of the first and second pairs of side portions 52 and 56, respectively, or approximately 12 to 12.25 inches wide and approximately 16 to 16.25 inches long. The first and second pairs of side portions 52 and 56 also define a window 64 (or opening) which extends through the frame 50.

The frame 50 is one piece and preferably made from a homogeneous metallic material, such as a length of steel rod 70 as is illustrated in FIG. 2. Thus, the frame 50 is monolithic. The length of steel rod 70 is preferably 3/16 inches in diameter but could have a different diameter. The length of steel rod 70 shown has a circular cross-section, but could have a cross-section of a different shape. The four corners 60 of the frame 50 are formed by bending the length of steel rod 70 into the rectangular shape shown.

In the preferred embodiment, one of the second pair of side portions 56 of the frame 50 includes an overlap section 72. The overlap section 72 is formed by overlapping opposite terminal end portions 74 and 76 of the length of steel rod 70 and welding them together (FIGS. 2 and 3). The welding can be at one location or at plural locations. The overlap portion 72 forms a part of one side portion 56.

The resilient material of the frame 50 permits the frame to be manually deformed from the first condition to a second condition. In the second condition, either one or both of the first and second pairs of side portions 52 and 56 of the frame 50 are curved to an extent. The second condition of the frame 50 is not one specific geometric shape, but rather any one of many shapes that the frame may take when manually deformed. The curvature of either or both of the first and second pairs of side portions 52 and 56 extends in a vertical direction, as indicated by arrow A in FIG. 1. Thus, in the second condition, the first and second pairs of side portions 52 and 56 of the frame 50 no longer lie in a common plane.

The apparatus 10 can be installed into the bag 20 in any number of ways, for example, by first inserting one of the second pair of side portions 56 of the frame 50 through the mouth 40 of the bag. The entire frame 50 is then inserted through the mouth 40 of the bag 20 as shown by dashed lines in FIG. 1. The frame 50 is rotated inside the bag 20, as indicated by the arrows B in FIG. 1, such that the first and second pairs of side portions 52 and 56 of the frame are adjacent but not engaging the first and second pairs of side walls 22 and 26, respectively, of the bag.

The frame 50 is now manually deformed from its first condition toward its second condition by moving either or both of the first and second pairs of side portions 52 and 56 toward one another, causing curvature in the side portions 52 and 56 such that the side portions no longer line in a common plane. The frame 50 is then moved to its final installed location adjacent the mouth 40 of the bag 20. Preferably, the final location of the frame 50 should be about four inches below the mouth 40 of the bag 20. If the frame 50 is too far from the mouth 40, the mouth could tend to close because of the flexible nature of the material of the bag 20.

It should be apparent that the frame 50 could, alternatively, be manually deformed outside the bag 20 and inserted into the bag in its second deformed condition.

When the manual pressure on the frame 50 is released, the first and second pairs of side portions 52 and 56 spring back toward the first condition of the frame in which the side portions lie in a common plane and, thus, spring into engagement with the first and second pairs of side walls 22 and 26, respectively, of the bag 20. Because the outer perimeter 62 of the frame 50 is larger than the mouth 40 of the bag 20, the frame tensions at least one pair of the first and second pairs of side walls 22 and 26 of the bag, thereby keeping the frame in place and the mouth 40 of the bag open. In the preferred embodiment, all four side walls 22 and 26 of the bag are tensioned.

Another way in which the apparatus 10 can be installed into the bag 20 is by placing the frame 50 through the mouth 40 of the bag with the frame tilted at an angle relative to the horizontal plane of the mouth. The frame 50 is then slowly drawn in an upward direction, indicated by arrow A in FIG. 1, into a substantially level position adjacent the mouth 40 of the bag 20. As the frame 50 is being drawn up to the substantially level position, at least one pair of the first and second pairs of side portions 52 and 56 engage and tension at least one pair of the first and second pairs of side walls 22 and 26 of the bag 20 to hold the mouth 40 of the bag open. In the preferred embodiment, all four side walls 22 and 26 of the bag are tensioned. The frame 50 is held in the substantially level position in the bag 20 by frictional contact between the side portions 52 and 56 of the frame and the engaged side walls 22 and 26 of the bag.

With the mouth 40 of the bag 20 being held open by the frame 50, material may be placed into the compartment 38 in the bag by inserting it through the open mouth 40 and through the window 64 defined by the frame. Once a sufficient quantity of material has been placed into the bag 20, the mouth 40 of the bag will remain open by itself, and the frame 50 can be removed. The frame 50 is removed by reversing either of the procedures set forth above. The frame 50 can then be used with another bag if desired.

An alternate construction of the invention is shown in FIG. 4. In FIG. 4, the frame 50' is a one-piece resilient rod made of a homogeneous plastic material. Thus, the frame 50' is monolithic. The plastic frame 50' is identical to the frame 50 described above except that the first and second pairs of side portions 52' and 56' of the plastic frame 50' have a larger diameter than the pairs of side portions 52 and 56 of the steel rod frame 50. Further, the plastic frame 50' does not include an overlap section 72. The plastic frame 50' is illustrated as having a circular cross-section, but could have a cross-section of a different shape. Functionally, the plastic frame 50' operates in the same manner as described above for the steel rod frame 50.

Another alternate construction of the invention is shown in FIG. 5. In FIG. 5, the frame 50" is a one-piece resilient rod made of a homogeneous rubber material. Thus, the frame 50" is monolithic. The rubber frame 50" is identical to the frame 50 described above except that the first and second pairs of side portions 52" and 56" of the rubber frame 50" have a larger diameter than the pairs of side portions 52 and 56 of the steel rod frame 50. Further, the rubber frame 50" does not include an overlap section 72. The rubber frame 50" is illustrated as having a circular cross-section, but could have a cross-section of a different shape. Functionally, the rubber frame 50" operates in the same manner as described above for the steel rod frame 50.

From the above description of the invention, those skilled in the art will perceive improvements, changes and modifications. For example, the frame member could be sized accordingly for use with a larger bag, such as a bag which is approximately 12 inches wide and approximately 18 inches long. Such improvements, changes and modifications within the skill of the art are intended to be covered by the appended claims.

Having described the invention, I claim:

1. An apparatus comprising a bag having a flat bottom wall and four side walls which extend between said bottom wall and a mouth of said bag, said flat bottom wall of said bag having a bottom surface for engaging a support surface with said side walls of said bag disposed in a rectangular array which extends upward from said bottom wall in a direction away from the support surface to said mouth of said bag, said side walls of said bag having inner side surfaces which extend between said mouth and said flat bottom wall of said bag, and frame means for holding said mouth of said bag in an open condition by applying force only against said inner side surfaces of said side walls of said bag at a location adjacent to said mouth of said bag while said side walls of said bag extend upward from said flat bottom wall in a rectangular array to said mouth of said bag, said frame means consisting of four sides which are interconnected to each other at four corners, said sides and corners of said frame means being made from a single resilient material and defining a rectangular opening, when in an unrestrained condition said frame means being disposed substantially in a single plane, when in a restrained condition said frame means not being disposed in a single plane, each of said sides of said frame means including side surface means for applying force against said inner side surface of one of said side walls of said bag at a location adjacent to said mouth of said bag, said frame being disposed entirely within said bag and located above and spaced from said flat bottom wall of said bag, said frame means being supported above said flat bottom wall of said bag by only the inner side surfaces of said side walls of said bag.

2. An apparatus as set forth in claim 1 wherein said frame means has an outer perimeter which is larger than a rectangular opening formed by said mouth of said bag.

3. An apparatus as set forth in claim 1 wherein said frame means is entirely formed by a bent steel rod and said bag is entirely made of paper.

4. A method of holding open a rectangular mouth of a bag having a flat bottom wall and four side walls to facilitate placing material into the bag, said method comprising the steps of:

positioning the flat bottom wall of the bag in engagement with a support surface with the four side walls of the bag extending upward in a rectangular array from the bottom wall of the bag to the mouth of the bag;

providing a rectangular frame made entirely of a single resilient material, the frame consisting of four interconnected side portions disposed in a rectangular array defining a rectangular opening when the frame is in an unrestrained condition, the entire frame being disposed substantially in a single plane when in the unrestrained condition, the rectangular array formed by the side portions of the unrestrained frame having an outer perimeter which is larger than a rectangular opening formed by the mouth of the bag when the mouth of the bag is open;

manually deflecting the frame from the unrestrained condition to a restrained condition in which all four side portions of the frame are resiliently deflected, the frame no longer being disposed in a single plane when in the restrained condition;

positioning the entire frame inside the bag;

manually releasing the frame to allow for movement of the frame from the restrained condition back toward the unrestrained condition while the entire frame is inside the bag;

applying force against only interior surfaces of the side walls of the bag with the side portions of the frame due to the frame tending to return to its unrestrained condition to hold the mouth of the bag open under the influence of force applied against interior surfaces of the side walls of the bag by the frame; and supporting the frame entirely within the bag above the support surface by only the interior surfaces of the side walls of the bag by transmitting through the side walls of the bag to the support surface the weight of the frame while the frame holds the mouth of the bag open with the side walls of the bag extending upward from the support surface in the rectangular array.

5. A method as set forth in claim 4 wherein said step of manually deflecting the frame is at least partially performed with the frame outside the bag.

6. A method as set forth in claim 4 wherein said step of manually deflecting the frame is at least partially performed with the frame inside the bag.

* * * * *